United States Patent [19]

Sando et al.

[11] 4,112,713

[45] Sep. 12, 1978

[54] SELVAGE CURLING PREVENTION APPARATUS FOR A KNITTED CLOTH

[75] Inventors: Yoshikazu Sando; Hiroshi Ishidoshiro, both of Wakayama, Japan

[73] Assignee: Sando Iron Works Co., Ltd., Japan

[21] Appl. No.: 788,466

[22] Filed: Apr. 18, 1977

[30] Foreign Application Priority Data

Apr. 26, 1976 [JP] Japan ..... 51-47521

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS 2,367,174 1/1945 Renkin ..... 68/5 E X 2,865,112 12/1958 Annesser ..... 68/5 E X 3,158,507 11/1964 Alexander ..... 68/5 E X

*Primary Examiner*—Philip R. Coe

*Attorney, Agent, or Firm*—Toren, McGeady and Stanger

[57] ABSTRACT

A selvage curling prevention apparatus for a knitted cloth characterized in that pairs of metal rolls or pairs of metal walls, forming very narrow gaps to allow a knitted cloth to pass therethrough in a flat state, are provided in multiple steps in one straight line within a passage which is connected to a high pressure steamer vessel and has the cloth pass therethrough, further the metal rolls and metal walls are heated by steam heat supplied from said high pressure steamer vessel into the passage and at a same time humid heat is applied to the cloth.

7 Claims, 2 Drawing Figures

SELVAGE CURLING PREVENTION APPARATUS FOR A KNITTED CLOTH

Figure 1:
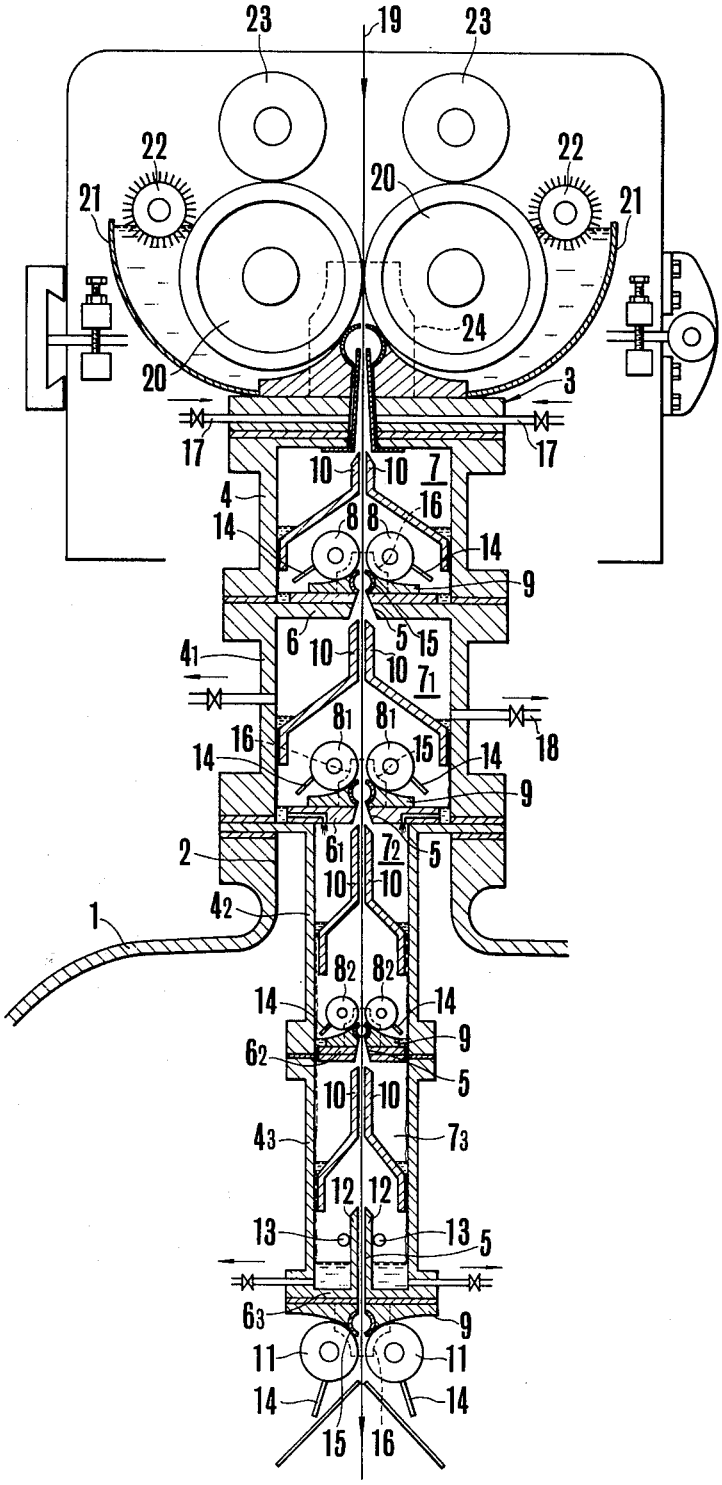

The present invention relates to an apparatus to prevent selvage curling which takes place in a knitted cloth made of synthetic fiber or containing synthetic fiber.

A majority of knitted cloth or a round drum knitted material made of synthetic fiber or containing synthetic fiber tends to have selvage curling generated at both side edges of the same during bleaching, preparation for dyeing or other processings thereof, and the selvage curling not only causes uneven bleaching, and uneven dyeing spots but also makes the processing operations very difficult. Therefore for preventing this selvage curling, a method of coating both side selvage parts of the cloth or round drum knitted material with sizing agent containing resin or other chemicals and to dry it under dry heat for setting the same, or a means for employing a clip tenter have been used heretofore in many instances. However in the selvage curling prevention method using a sizing agent or chemicals, the sizing agent or chemicals are removed during the processing of the cloth or material losing the selvage curling prevention effect and causing various difficulties. Furthermore since both side edge selvage portions are coated with sizing agent or chemicals in the selvage curling prevention method, the portions having the sizing agent or chemicals coated thereon must be cut off and scrapped, requiring a cutting off operation, and further resulting in wastage by such cutting off.

Also, the selvage curling prevention method using a clip tenter has disadvantages in complicating the apparatus itself, etc.

The present invention is to eliminate the object of the above mentioned shortcomings and disadvantages with selvage curling prevention apparatus consisting of pairs of metal rolls or metal walls forming very narrow gaps through which knitted cloth passes in a flat state. The rolls or walls are provided in multiple steps in one straight line within a passage through which the cloth passes. The metal rolls or metal walls are heated by steam heat supplied into the passage, further humid heat is applied to the cloth. The present invention is characterized by effective thermal setting so that selvage curling can be prevented within a short period of time (about one second) by the combined effects of the heating by the metal rolls or metal walls and the humid heat supplied into the passage.

Now the present invention will be explained in detail based on examples shown in the drawings.

Figure 2:
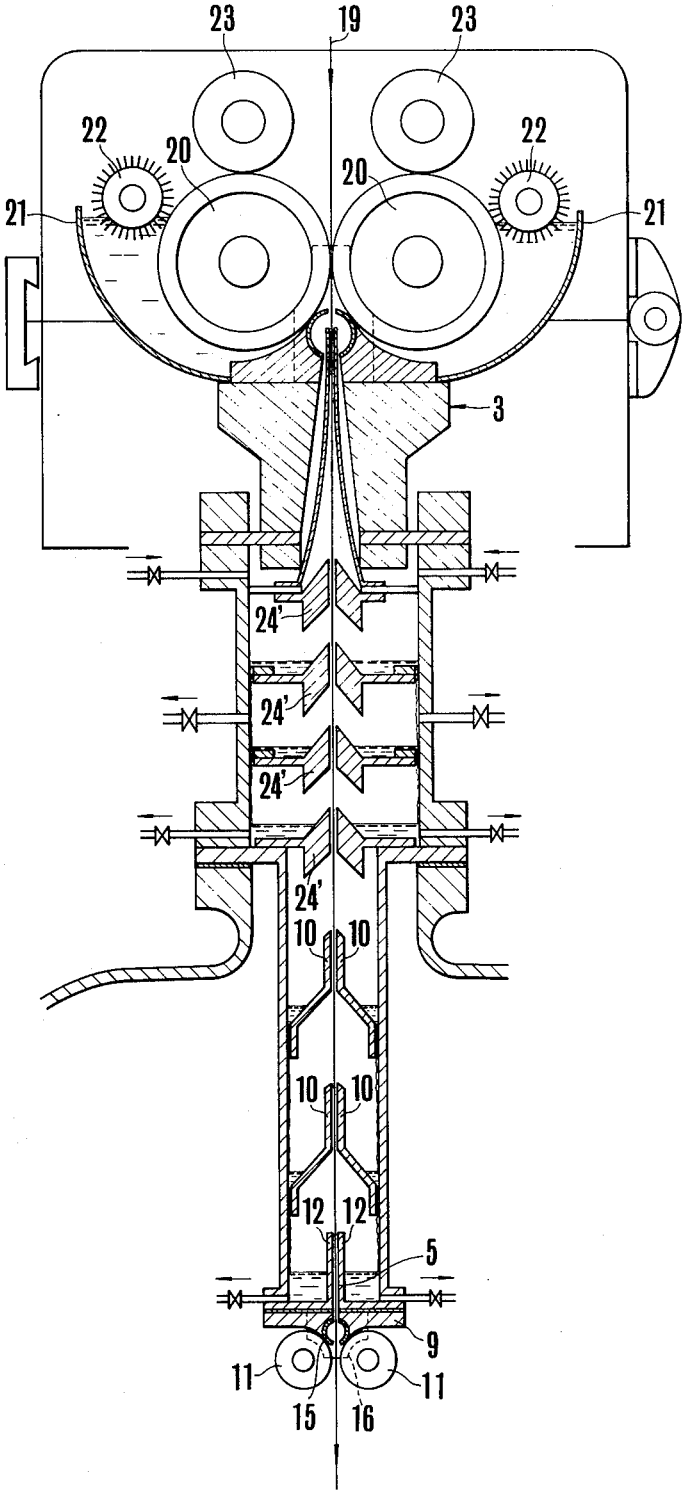

The drawings show examples of sealing apparatus according to the present invention, wherein FIG. 1 is a cross sectional view of one example thereof and FIG. 2 is a cross sectional view of another example.

In FIG. 1, what is shown as 1 is a vessel of a high pressure steamer, and a fiber product inlet 2 of the vessel 1 has a sealing device 3 to be described below provided thereto. The sealing device 3 has a tubular shape fiber product passage which is vertically connected through and is formed by each of sealing blocks 4, $4_1$, $4_2$, $4_3$, and of dividing walls 6, $6_1$, $6_2$, $6_3$ having fiber product passage holes 5 are provided between the sealing blocks of the cloth passage. The interior of each of the sealing blocks is formed as pressure reduction chamber 7, $7_1$, $7_2$, $7_3$, respectively by the dividing walls 6, $6_1$, $6_2$, $6_3$. Pairs of metal gap rolls 8, $8_1$, $8_2$ are rotatably provided on frames 9 above the dividing walls 6, $6_1$, $6_2$, respectively and form being opposedly provided with some gaps therebetween for example, gaps of 0.2 to 10mm allowing woven cloth or knitted cloth to pass therethrough. Pairs 1 of water drop protection plates 10 are positioned above the metal gap rolls within each of the pressure reduction chambers. A pair of metal gap rolls 11 is provided in a freely rotatable manner, at the outside of the pressure reduction chamber $7_3$ on the frame 9, these gap rolls provided a gap of 0.2 to 10mm as in the above mentioned gap rolls. A a water drop protection plate 12 is integrally fixed on the dividing wall $6_3$, and a heating means 13 prevents dew from adhering onto the surface of the water drop protection plate 12. Wiping members made of felt, etc. in contacting with each of the metal gap rolls, remove dew adhered on the surface of the metal gap rolls. and elastic sealing pieces 15 are provided interveningly between the metal gap rolls and the frames 9. Roll end plane sealing plates 16 abut the opposite ends of the gap rolls, and pressurized air blow-in pipes 17 are connected to the sealing blocks. Pressure reduction pipes 18 are connected to the pressure reduction chambers and a cloth 19 passes through the sealing device and the pressure reduction chamber.

A pair of sealing rubber rolls 20 are in pressure contact with one another and are provided above the sealing block 4 at the uppermost step, and the fiber product passage hole 5, open through the sealing block 4, is closed by the pair of sealing rubber rolls 20. A cooling and cleaning tank (21) is provided for the sealing rubber rolls 20. Cleaning brush rolls 22 and wiping rolls 23 are located adjacent the periphery of the sealing rubber rolls 20, while a sealing end plate 24 abuts the ends of the rolls (20). The, sealing rubber rolls 20, the tank 21, brush rolls 22, wiping rolls 23 and the sealing end plate 24 constitute a roll sealing mechanism. Such roll sealing mechanism is not only needed in the present invention but is an example of such a mechanism which enhances the sealing effect.

As has been explained above, in this example many pairs of metal gap rolls having gaps (for example 0.2 to 10mm gaps) through which a cloth can pass in a flat manner and provide a fiber product passage connected to inside of the high pressure steamer vessel 1 in the moving direction of the fiber product, and the cloth was made to pass through the gap between each of said gap rolls, thereby securing very effective thermal setting which prevents selvage curling by the heating provided by each pair of metal gap rolls and the humid heat from the steamer.

In experimentation the above mentioned pairs of gap rolls were provided in four steps and the gap rolls were heated to an average temperature of 110° C and knitted cloth was passed through the gaps between rolls at a speed of 60cm per second, and the selvage curling of the knitted cloth was eliminated.

In the example shown in FIG. 2 plural pairs of gapped metal walls 24' are provided in steps in place of the above mentioned pairs of metal gap rolls, and since these gapped metal walls 24' are heated by humid heat from the steamer as in the above example, insert a similar effect of preventing selvage curling can be obtained by passing a cloth through the gaps of the gapped metal walls 24'. Also since the gapped metal walls 24' function as water drop protection plates in this example, the structure of the apparatus can be made simple.

What is claimed is:

1. A selvage curling prevention apparatus for a knitted cloth comprising a high pressure steamer vessel having a cloth inlet, wall means mounted on and extending outwardly from said vessel and forming an elongated passageway through said cloth inlet into said vessel for the straight line passage of the cloth through the passageway into said steamer vessel, said passageway having a first end located exteriorly of said vessel and a second end located within said vessel, a roll sealing mechanism located at the first end of said passageway and including a pair of sealing rolls positioned at the first end of said passageway and forming a seal closure for the cloth being introduced into said passageway for subsequent passage into said vessel, said wall means including transverse walls dividing said elongated passageway transversely of its elongated direction into a plurality of serially arranged pressure reduction chambers with said transverse walls forming aligned openings disposed in a straight line therethrough for passage of the cloth between adjacent said pressure reduction chambers, said transverse walls having a first side closer to the first end of said passageway and a second side facing in the opposite direction and being closer to the second end of said passageway, pairs of first metal gap rolls each mounted on the first side of at least a plurality of adjacent said transverse walls commencing with said transverse wall closest to the first end of said passageway, each said pair of metal gap rolls forming a gap therebetween selected so that the cloth can pass therethrough in a flat manner, a pair of second metal gap rolls located on the second side of said transverse wall located at the second end of said passageway and positioned within said vessel and said pair of second metal gap rolls having a gap therebetween corresponding to the gap of said pairs of first metal gap rolls and permitting steam from said vessel into said passageway so that the steam heats the metal gap rolls for heating the cloth and the steam within said passageway also supplies humid heat to the cloth while said pair of sealing rolls seal the first end of said passageway.

2. A selvage curling prevention apparatus, as set forth in claim 1, wherein the gap formed between said first and second pairs of metal gap rolls being in the range of 0.2 to 10mm.

3. A selvage curling prevention apparatus, as set forth in claim 1, including means for wiping said first and second metal gap rolls spaced angularly about said gap rolls for the gap therebetween for removing dew from said gap rolls.

4. A selvage curling prevention apparatus, as set forth in claim 1, including water drop protection plates located within said passageways above each said first pair of metal rolls.

5. A selvage curling prevention apparatus, as set forth in claim 1, wherein pressure reducing pipes are connected to said pressure reduction chambers.

6. A selvage curling prevention apparatus, as set forth in claim 1, including means for supplying pressurized air into said passageway.

7. A selvage curling prevention apparatus, as set forth in claim 1, including an elastic sealing piece associated with each one of said first and second metal gap rolls, said elastic sealing pieces associated with each said pair of first end metal gap rolls being located on the opposite sides of the cloth as it passes through said passageway.

* * * * *